United States Patent [19]

Hayakawa et al.

[11] Patent Number: 4,821,077

[45] Date of Patent: Apr. 11, 1989

[54] CLEANER FOR TONER FIXING DEVICE

[75] Inventors: Mitsuaki Hayakawa; Hiroyoshi Tokoro; Kiyoo Kawate, all of Ibaraki, Japan

[73] Assignee: Hitachi Koki Co., Ltd., Tokyo, Japan

[21] Appl. No.: 109,375

[22] Filed: Oct. 19, 1987

[30] Foreign Application Priority Data

Oct. 17, 1986 [JP] Japan ..... 61-248094

[51] Int. Cl.[4] ..... G03G 15/20

[52] U.S. Cl. ..... 355/3 FU; 355/14 FU; 355/15; 219/216

[58] Field of Search ..... 355/15, 3 FU, 14 FU, 355/3 R; 219/216

[56] References Cited

U.S. PATENT DOCUMENTS

| | | | |
|---|---|---|---|
| 4,579,802 | 4/1986 | Kishi et al. | 355/3 FU X |
| 4,593,992 | 6/1986 | Yoshinaga et al. | 355/3 FU |
| 4,616,917 | 10/1986 | Sakurai | 355/3 FU |
| 4,652,110 | 3/1987 | Sato et al. | 355/3 FU |

*Primary Examiner*—A. C. Prescott

*Attorney, Agent, or Firm*—Sughrue, Mion, Zinn, Macpeak & Seas

[57] ABSTRACT

A cleaner for a toner fixing device in an electrophotographic machine or the like. A housing is provided near a pair of fixing rollers, and an endless-belt type felt member is partially disposed in the housing in a folded state. The remaining portion of the felt extends outside of the housing and contacts one of the fixing rollers while the felt is being pressed upon by a drive roller and pressure member. The felt is moved at a slow speed, preferably such that its service life corresponds to one rotation of the felt.

4 Claims, 2 Drawing Sheets

CLEANER FOR TONER FIXING DEVICE

BACKGROUND OF THE INVENTION

The present invention relates to a cleaner for a toner fixing device in an electrophotographic printer or the like.

In a toner fixing device of the thermal type, paper to which a toner image adheres due to electrostatic force or the like is moved through the nip of a pair of heated fixing rollers whereby the toner image is fused to the paper. Normally, the surface of at least one of the fixing rollers is coated with a fluorine resin or the like, and a separating agent such as silicone oil is applied to the coating material to prevent the toner image from adhering to the fixing roller. However, in actuality a very small quantity of toner will usually remain on fixing roller. To remove such remaining toner from the fixing roller, a cleaning member is usually placed in contact with the roller.

FIG. 1 shows a conventional cleaner for a toner fixing device. Paper 10 is conveyed on paper guides 8 and 9 so that a toner image is fixed to the paper by a pair of fixing rollers composed of a heated roller 3 and a backup roller 7. A piece of felt 11 is positioned to contact the heated roller 3 to wipe away excess toner remaining on the roller 3. In this arrangement, however, it is necessary to frequency replace the felt. In other words, there is a disadvantage that the maintenance interval of the machine is short.

FIG. 2 shows another conventional cleaner for a toner fixing device. In this case, a cleaning member 12 composed of felt or other material is supplied from a roll, and the contaminated portion of a cleaning member 12 so formed is gradually wound up. The maintenance interval of the machine is thus increased. However, since there is a large distance between the supply and take-up rolls for the cleaning member, there is a disadvantage that the size of the cleaner is large. Moreover, since a device for regulating the speed of movement of the cleaning member 12 and an arrangement for detecting the quantity of the unused portion of the cleaning member need be provided, there is another disadvantage in that the construction of the cleaner is complicated.

FIG. 3 shows a cleaner disclosed in Japanese Utility Model Application (OPI) No. 112261/84. In this cleaner, an endless belt of felt 1 is tightly engaged between a drive shaft 13 and guide shafts 14. Although this cleaner has the advantage that the period of use of the felt 1 is long, the cleaner nevertheless has the disadvantage that the cleaner felt requires a relatively large space, and it is difficult to arrange the felt in the very narrow space available around the fixing roller.

FIG. 4 shows a cleaner of a type disclosed in Japanese Patent Application No. 13989/79. In this case, the cleaner is provided for a photosensitive body 16. A cleaning member 18 is made of a thin sheet of a material such as paper and a film. Since the rigidity of the thin sheet is low, it is difficult to neatly fold the thin sheet into a retrieval chamber 20 with a drive roller 17, and the thin sheet is likely to crinkle. For these reasons, the cleaning member 18 is likely to be skewed if it is circulated more than once. Hence, this cleaner has the disadvantage that the cleaning member can be used only once.

Moreover, silicone oil is always present between the cleaning member 18 and the fixing roller, reducing the coefficient of friction on the surface of the cleaning member. For that reason, there is a problem that it is difficult to stably drive the cleaning member with a single drive roller. The conventional cleaner shown in FIG. 3 has the same problem.

SUMMARY OF THE INVENTION

It is therefore an object of the present invention to provide a cleaner made of felt and having a reduced size and a lengthened service life.

In the cleaner provided in accordance with the present invention, felt having a good folding property and an endless form is compactly accommodated so as to reduce the size of the cleaner and lengthen the service life of the cleaner.

DESCRIPTION OF THE PREFERRED EMBODIMENTS

Figure 1:
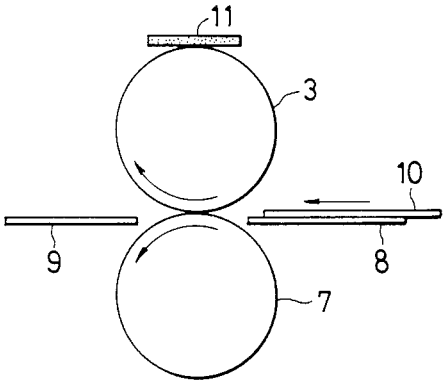
FIG. 1 PRIOR ART
FIGS. 1, 2, 3 and 4 show schematic views of conventional cleaners for fixation devices.
Figure 2:
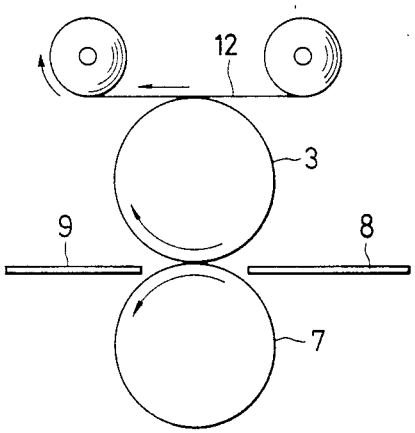
FIG. 2 PRIOR ART
Figure 3:
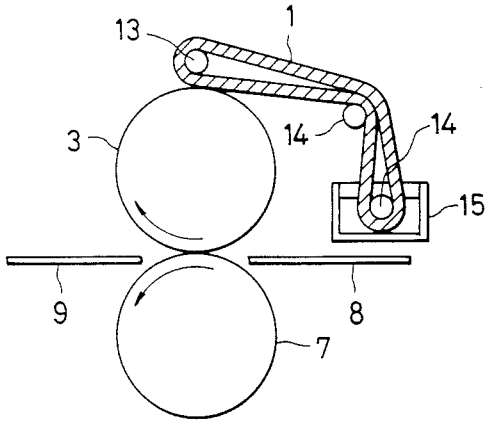
FIG. 3 PRIOR ART
Figure 4:
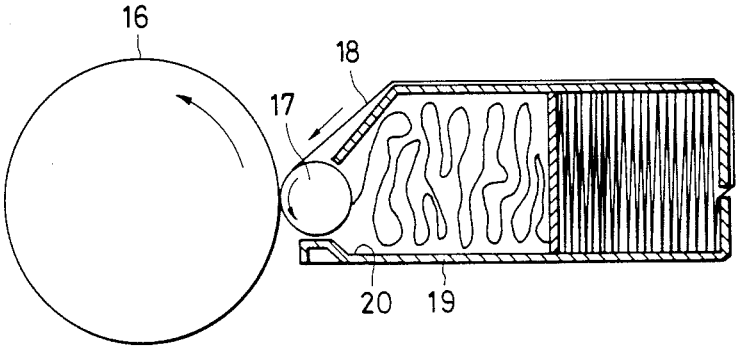
FIG. 4 PRIOR ART
Figure 5:
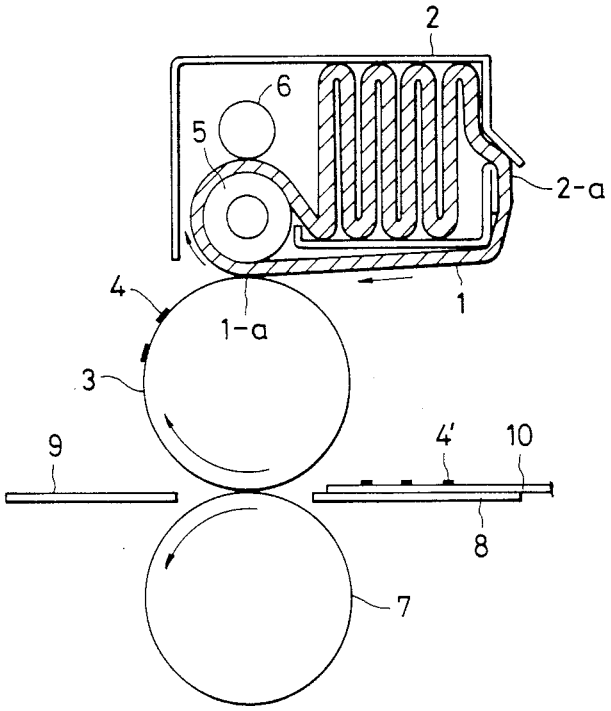
FIG. 5 shows a side view of a preferred embodiment of a cleaner of the present invention.

A preferred embodiment of the present invention will hereafter be described with reference to FIG. 5 showing a side view of a toner fixing device provided with a cleaner constructed according to the invention.

As shown in FIG. 5, a felt 1 in the form of an endless belt is accommodated in a housing 2 in a folded state. A portion 1-*a* of the felt 1 is always in contact with a heated roller 3 so that toner 4 clinging to the heated roller is removed therefrom. A drive roller 5 is rotated by a motor, a solenoid or the like (not shown in the drawing) to move the felt 1 at a very low speed or by a prescribed amount for a corresponding amount of printing so as to prevent too much toner 4 from being absorbed on the portion 1-*a* of the felt.

The felt 1 is pressed against the drive roller 5 by a pressure member 6 to increase the frictional force for moving the felt. As it is being moved into the housing 2 by the drive roller 5 and pushed into the interior of the housing, the felt is naturally bent and folded in layers due to the elasticity and rigidity of the felt itself, as shown in FIG. 5. For that reason, the accommodated quantity of the felt per unit volume of the cleaner is much larger than in the conventional cleaners. The felt 1 is pulled out of the housing 2 through the outlet opening thereof by rotation of the drive roller 5.

Two methods of establishing the period of use of the felt 1 can be employed. In the first method, the felt 1 is moved little by little so that one rotation of the felt is equal to the period of use of the felt. In the second method, the felt is moved through a predetermined number of rotations equal to the period of use of the felt.

Since the felt 1 is endless, the toner fixing device or other electrophotographic machine need not be stopped at the end of the period of use of the felt, which cannot be done in a conventional electrophotographic machine. Also, with the invention the cleaning efficiency of the cleaner does not fall sharply at the end of the period of use of the cleaner. For these reasons, the felt 1 can be replaced, depending on the number of sheets printed, at normal machine maintenance intervals.

It is preferable to form the felt 1 of heat-resistant nylon, Teflon, or the like. The elasticity and rigidity of the felt 1 need to be well balanced so as to allow the felt to easily fold into a zigzag. According to experiment, the most preferable thickness of the felt 1 for allowing natural zigzag folding thereof is about 0.5 mm to about 2 mm. If the thickness of the felt 1 is too small, the felt cannot be accommodated in layers in the housing 2. If the thickness of the felt 1 is too large, the felt cannot be smoothly bent.

If silicone oil is impregnated into the felt 1 or a device for feeding silicone oil to the felt is provided, the cleaner can be also used as a silicone oil feeding mechanism for the fixing rollers.

According to the present invention, an endless belt of felt is accommodated in a zigzag folded state so that a cleaner need not be stopped and the cleaning efficiency thereof does not sharply fall at the end of the period of use of the cleaner, and that the cleaner is made very compact while the felt accommodation capacity is made large. Since the winding diameter of the felt does not change, regulation of the speed thereof is not needed. For that reason, the cost of the cleaner is low and the reliability high.

What is claimed is:

1. A cleaner for a fixing device of an electrophotographic machine or the like in which paper to which a toner image is transferred is moved through the nip of pair of fixing rollers to fix the image to said paper, comprising:

a housing provided near one of said fixing rollers;

an endless felt belt disposed in said housing; and a drive roller and a pressure member provided in said housing at one end thereof, said pressure member facing said drive roller and said belt being pushed against said one of said fixing rollers by said drive roller while said belt is conveyed by said drive roller and said pressure member into said housing through one side thereof and is gradually pulled out of said housing through another side thereof, said belt having balanced elasticity and rigidity characteristics such that it naturally folds into a compact zigzag configuration within the housing.

2. The cleaner of claim 1, wherein said belt is made of a heat resistant material selected from the group consisting of nylon and Teflon.

3. The cleaner of claim 1, wherein a thickness of said belt is in a range of 0.5 to 2 mm.

4. The cleaner of claim 1, wherein said belt is impregnated with silicone oil.

* * * * *